US007098177B1

(12) United States Patent
Kubota et al.

(10) Patent No.: US 7,098,177 B1
(45) Date of Patent: Aug. 29, 2006

(54) PROCESS FOR PRODUCING DETERGENT PARTICLES

(75) Inventors: Teruo Kubota, Wakayama (JP); Hitoshi Takaya, Wakayama (JP); Hiroyuki Yamashita, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/581,594

(22) PCT Filed: Oct. 14, 1999

(86) PCT No.: PCT/JP99/05697

§ 371 (c)(1),
(2), (4) Date: Jun. 15, 2000

(87) PCT Pub. No.: WO00/23560

PCT Pub. Date: Apr. 27, 2000

(30) Foreign Application Priority Data

Oct. 16, 1998 (JP) ..... 10/295819
May 27, 1999 (JP) ..... 11/148405

(51) Int. Cl.
*C11D 11/00* (2006.01)

(52) U.S. Cl. ..... 510/444; 510/441; 510/351; 510/356; 510/357; 510/443; 510/452; 264/117; 264/140

(58) Field of Classification Search ..... 510/444, 510/441, 351, 356, 357, 443, 452; 264/117, 264/140
See application file for complete search history.

(56) References Cited

U.S. PATENT DOCUMENTS

| | | | | |
|---|---|---|---|---|
| 3,886,098 | A | 5/1975 | DiSalvo et al. | |
| 4,260,651 | A * | 4/1981 | Wixon | 427/214 |
| 4,264,464 | A * | 4/1981 | Gangwisch et al. | 510/323 |
| 4,310,431 | A | 1/1982 | Joshi | |
| 4,399,048 | A * | 8/1983 | Gangwisch et al. | 510/323 |
| 4,457,854 | A * | 7/1984 | Gangwisch et al. | 510/356 |
| 4,462,804 | A * | 7/1984 | Gangwisch et al. | 8/137 |
| 4,666,740 | A * | 5/1987 | Wixon | 510/356 |
| 4,725,455 | A * | 2/1988 | Taha | 510/443 |
| 4,853,259 | A * | 8/1989 | Taha | 510/441 |
| 5,024,778 | A * | 6/1991 | Grecsek | 510/349 |
| 5,080,820 | A * | 1/1992 | Grecsek | 510/443 |
| 5,133,924 | A * | 7/1992 | Appel et al. | 510/444 |
| 5,139,593 | A * | 8/1992 | Dominique et al. | 156/73.2 |
| 5,149,455 | A * | 9/1992 | Jacobs et al. | 510/443 |
| 5,468,516 | A * | 11/1995 | Yamashita et al. | 510/441 |
| 5,529,715 | A | 6/1996 | Kuroda et al. | |
| 5,565,422 | A * | 10/1996 | Del Greco et al. | 510/443 |
| 5,705,473 | A * | 1/1998 | Kuroda et al. | 510/441 |
| 5,736,501 | A * | 4/1998 | Yamashita et al. | 510/444 |
| 5,795,856 | A * | 8/1998 | Hatano et al. | 510/444 |
| 5,945,395 | A * | 8/1999 | Yamashita et al. | 510/444 |
| 6,159,920 | A * | 12/2000 | Ridyard | 510/324 |
| 6,376,453 | B1 | 4/2002 | Kubota et al. | 510/438 |
| 6,602,846 | B1 * | 8/2003 | Kubota et al. | 510/444 |

FOREIGN PATENT DOCUMENTS

| | | |
|---|---|---|
| BE | 851816 | 6/1977 |
| EP | 327963 | 8/1989 |
| EP | 0353976 A1 * | 2/1990 |
| EP | 388705 | 9/1990 |
| EP | 513824 | 11/1992 |
| FR | 1520948 A | 4/1968 |
| GB | 1579261 | 11/1980 |
| JP | 57159898 | 10/1982 |
| JP | 57173000 | 10/1982 |
| JP | 02232299 | 9/1990 |
| JP | 02232300 | 9/1990 |
| JP | 05125400 | 5/1993 |
| JP | 05209200 | 8/1993 |
| JP | 07289259 | 7/1995 |
| JP | 08003599 | 1/1996 |
| JP | 08034999 | 2/1996 |
| JP | 08170095 | 7/1996 |
| JP | 08302391 | 11/1996 |
| JP | 08302398 | 11/1996 |
| JP | 09059699 | 3/1997 |
| JP | 09087691 | 3/1997 |
| JP | 09087694 | 3/1997 |
| JP | 09087697 | 3/1997 |
| JP | 09151392 | 10/1997 |
| JP | 09279193 | 10/1997 |
| JP | 09279200 | 10/1997 |
| JP | 09302390 | 11/1997 |
| JP | 10088199 | 4/1998 |
| JP | 10158699 | 6/1998 |

(Continued)

*Primary Examiner*—Lorna M. Douyon
(74) *Attorney, Agent, or Firm*—Birch, Stewart, Kolasch & Birch, LLP

(57) ABSTRACT

A process for preparing detergent particles containing step (I): mixing a base particle for supporting a surfactant ((a) component), and a surfactant composition ((b) component), under mixing conditions wherein the (a) component does not substantially undergo breakdown, to give a mixture; wherein the base particle is obtained by spray-drying an aqueous slurry, wherein the mixing operation is carried out by using a mixer containing agitation impellers, and where the mixer further contains disintegration impellers, the mixing operation step (I) is carried out without substantially rotating the disintegration impellers; and step (II): mixing the mixture obtained in step (I) with 5 to 100 parts by weight of fine powder, while substantially maintaining the shape of the (a) component containing (b) component, to give detergent particles, having a degree of particle growth of 1.3 or less, and a bulk density of 500 g/L or more.

13 Claims, No Drawings

FOREIGN PATENT DOCUMENTS

| | | |
|---|---|---|
| JP | 10176200 | 6/1998 |
| JP | 11043700 | 2/1999 |
| JP | 10152700 | 6/1999 |
| JP | 11172279 | 6/1999 |
| JP | 11293290 | 10/1999 |
| JP | 11293293 | 10/1999 |
| JP | 11302699 | 11/1999 |
| JP | 11310790 | 11/1999 |
| WO | WO-94/05761 A1 * | 3/1994 |

* cited by examiner

PROCESS FOR PRODUCING DETERGENT PARTICLES

This application is the national phase under 35 U.S.C. § 371 of PCT International Application No. PCT/JP99/05697 which has an International filing date of Oct. 14, 1999, which designated the United States of America.

TECHNICAL FIELD

The present invention relates to a process for preparing detergent particles comprising adding a surfactant composition.

BACKGROUND ART

A process in which a liquid surfactant such as a nonionic surfactant is used for a powder detergent includes a process of supporting a liquid surfactant on a powder.

Japanese Patent Laid-Open No. Sho 52-110710 discloses a granular detergent comprising a liquid or liquefiable organic substance contained in an inner portion of base material beads having porous outer surface and skeletal inner structure, wherein a nonionic surfactant is not substantially present on the beads surface. However, in this technique, the beads cannot include liquid ingredients in amounts of not less than an oil-absorbable amount, and moreover, liquids are more likely to remain on the particle surface as the amount of the surfactant formulated increases, thereby making its flowability poor. Therefore, the amount of the surfactant formulated by this technique cannot be increased.

Japanese Patent Laid-Open No. Hei 5-209200 discloses a process for preparing a nonionic detergent particle, comprising using, as raw materials for detergents, a mixture comprising a nonionic surfactant as a main base material; forming a deposition layer of the raw materials for detergents on a wall of an agitation mixer comprising agitation impellers and having a clearance between the agitation impellers and the mixer wall; and granulating with increasing a bulk density by the agitation impellers. However, in this technique, the process is complicated, and as the amount of a surfactant formulated varies, the particle size of the detergent particle varies. Further, in this technique, as a matter of course, the deposition of the raw materials for detergents in the mixer is remarkable, which may cause variations in the particle size and the bulk density of the detergent particle depending upon the deposition conditions.

Further, Japanese Patent Laid-Open No. Hei 10-176200 discloses a process for preparing nonionic detergent granules comprising previously mixing a nonionic surfactant, a water-soluble, nonionic, organic compound having a melting point of 45° C. or more, and an acid precursor of a fatty acid or the like, to give a liquid mixture; and granulating a mixture of the resulting liquid mixture with raw materials for detergents, with tumbling with an agitation mixer, thereby increasing its bulk density. However, the fatty acid reacts in the nonionic surfactant by contacting the liquid mixture with an alkalizing agent, thereby causing gelation (nonionic surfactant/soap gel). Therefore, the surfactant composition comprising a nonionic surfactant is less likely be absorbed and embedded in powder raw materials having supporting ability, and the powder raw materials are aggregated with the gelated product acting as a binder, whereby the granulation proceeds. In other words, in the above process, the granulation proceeds without sufficiently exhibiting its supporting ability, even when using powder raw materials having supporting ability in the powder raw materials, so that a large amount of the surfactant cannot be formulated. When a large amount of the surfactant is to be formulated, granules having sizes outside of the desired particle size ranges are formed, so that it tends to be disadvantageous in the dissolubility.

Therefore, in order to produce products having stable quality, it is very important to construct a process for preparing powder detergents for obtaining products having stable quality with respect to the variation in the amount of the nonionic surfactant formulated. Especially, although a powder detergent having a high liquid surfactant content is excellent in the deterging performance, it has been difficult to produce a product having stable quality for the reasons given above, and the problem of adversely changing powder properties by containing a large amount thereof has not been solved thereby.

Accordingly, a first object of the present invention is to provide in a process for preparing detergent particles comprising a surfactant composition, the process for obtaining detergent particles in high yield capable of easily adjusting an average particle size and a particle size distribution by selection of base particles in a simple preparation process, wherein the variations of the average particle size and the particle size distribution of the detergent particles are small with respect to the variation of the amount of the surfactant composition formulated. Further, a second object of the present invention is to provide a process for preparing detergent particles which are excellent in powder properties, such as flowability, of the detergent particles, and are capable of formulating a large amount of the surfactant composition. Further, a third object of the present invention is to provide in a process for preparing detergent particles comprising a nonionic surfactant, the process for preparing detergent particles having a large surfactant content in a simple preparation process, excellent dissolubility, and being excellent in the suppression of exudation of the nonionic surfactant and in the anti-caking property. These objects and other objects of the present invention will be apparent from the following description.

DISCLOSURE OF INVENTION

Specifically, the present invention relates to a process for preparing detergent particles, comprising the steps of:

(I): mixing a base particle for supporting a surfactant ((a) component); and 15 to 100 parts by weight of a surfactant composition ((b) component), based on 100 parts by weight of said (a) component, the base particle having an average particle size of from 150 to 500 μm, a bulk density of 400 g/L or more, and a particle strength of 50 kg/cm$^2$ or more, under mixing conditions such that said (a) component does not substantially undergo breakdown, to give a mixture; and (II): mixing the mixture obtained in step (I) with 5 to 100 parts by weight of fine powder, based on 100 parts by weight of the mixture, with substantially maintaining the shape of (a) component containing (b) component, to give detergent particles, wherein the detergent particles have a degree of particle growth of 1.5 or less, and a bulk density of 500 g/L or more.

BEST MODE FOR CARRYING OUT THE INVENTION 1. (a) Component (a) Component refers to a base particle for supporting a surfactant (simply referred to as "base particle"), the base particle having an average particle size of from 150 to 500 μm, a bulk density of 400 g/L or more, and a particle strength of 50 kg/cm$^2$ or more. More preferable as (a) component are those having a supporting ability of 20 mL/100 g or more.

(a) Component has an average particle size of from 150 to 500 μm, preferably from 180 to 350 μm, from the viewpoint of obtaining detergent particles excellent in the dissolubility and the flowability. The bulk density is 400 g/L or more, preferably 500 g/L or more, from the viewpoint of the compression of the detergent particles. Also, the bulk density is preferably 1500 g/L or less, more preferably 1200 g/L or less, from the viewpoint of the dissolubility. The particle strength is 50 kg/cm$^2$ or more, and from the viewpoint of the stable productivity of the detergent particles, the particle strength is preferably 100 kg/cm$^2$ or more, more preferably 200 kg/cm$^2$ or more. The particle strength is 5000 kg/cm$^2$ or less, more preferably 3000 kg/cm$^2$ or less, from the viewpoint of the dissolubility. If (a) component has a particle strength within this range, the breakdown of the base particle during mixing in step (I) is substantially suppressed.

The supporting ability is preferably 20 mL/100 g or more, more preferably 30 mL/100 g or more, especially preferably 40 mL/100 g or more, from the viewpoint of enhancing the support of a surfactant composition. The "supporting ability" refers to the ability of the base particle to support a liquid component such as a surfactant inside and on the surface of the particle. When the supporting ability is within this range, the aggregation of (a) components is suppressed, thereby making it favorable for maintaining the uni-core property owned by the detergent particle in the detergent particles.

The average particle size is measured by vibrating a sample with each of standard sieves according to JIS Z 8801 for 5 minutes, and thereafter determining from a weight percentage depending upon the size openings of the sieves. The bulk density is measured by a method according to JIS K 3362.

The particle strength is measured by the following method.

A cylindrical vessel of an inner diameter of 3 cm and a height of 8 cm is charged with 20 g of a sample, and the sample-containing vessel (manufactured by Tsutsui Rikagaku Kikai K. K., "Model TVP1" tapping-type close-packed bulk density measurement device; tapping conditions: frequency of 36 times/minute, free flow from a height of 60 mm) is tapped for 30 times. The sample height (an initial sample height) at this time is measured. Thereafter, an entire upper end surface of the sample kept in the vessel is pressed at a rate of 10 mm/min with a pressing machine to take measurements for a load-displacement curve. The slope of the linear portion at a displacement rate of 5% or less is multiplied by an initial sample height, and the resulting product is divided by a pressed area, to give a quotient which is defined as particle strength.

The supporting ability of component (a) is measured by the following method.

A cylindrical mixing vessel of an inner diameter of 5 cm and a height of 15 cm which is equipped with agitation impellers in the inner portion thereof is charged with 100 g of a sample. With stirring the agitation impellers at 350 rpm, linseed oil at 25° C. is supplied into the vessel at a rate of 10 mL/min. The supporting ability is defined as an amount of linseed oil supplied when the agitation torque reaches the highest level.

(a) Component can be obtained by, for example, drying an aqueous slurry comprising a detergent builder and the like. Among them, the particle obtainable by spray-drying the aqueous slurry is preferable from the viewpoint of having desired property values. In addition, when (a) component is a spray-dried particle, it is more preferable because the detergent particles obtainable by the process of the present invention can actually have a fast dissolubility. The "fast dissolubility" refers to a property that the detergent particles have a dissolution rate described below of 90% or more.

The base particles in the present invention may be particles of any substances which are generally blended in a detergent and dissolved or dispersed in water. The base particles include, for example, particles exhibiting alkaline property such as tripolyphosphates, carbonates, bicarbonates, sulfites, silicates, crystalline aluminosilicates, and citrates; particles exhibiting neutral property or acidic property such as sodium sulfate, sodium chloride, and citric acid; or particles prepared by drying an aqueous slurry comprising various detergent builders by means of spray-drying or the like. The base particles may be constituted by single component alone, or may be constituted by a plurality of components.

Among them, the particles prepared by drying an aqueous slurry comprising a detergent builder are preferable as particles, from the viewpoint that the formulated amount of the surfactant composition can be made large. The base particles can be prepared, for example, by spray-drying an aqueous slurry comprising a water-insoluble inorganic compound, a water-soluble polymer and a water-soluble salt, in which the contents of each of the components are respectively from 20 to 90% by weight, from 2 to 30% by weight, and from 5 to 78% by weight, on the basis of solid ingredients in the aqueous slurry. Within the above compositional ranges, the particle strength, the bulk density and the average particle size of the base particles can be controlled by adjusting the drying process and the drying conditions.

Here, the water-insoluble inorganic compound includes crystalline or amorphous aluminosilicates; silicon dioxide, hydrated silicate compounds, clay compounds such as perlite and bentonite, and the like. The water-soluble polymer includes carboxylic acid-based polymers, carboxymethyl cellulose, water-soluble starches, sugars, and the like. The water-soluble salts include water-soluble inorganic salts representatively exemplified by alkali metal salts, ammonium salts or amine salts, each having carbonate group, hydrogencarbonate group, sulfate group, sulfite group, hydrogensulfate group, chloride group, phosphate group, or the like; and water-soluble organic salts having low molecular weights such as citrates and fumarates, and the like.

Other optional components which can be formulated in the aqueous slurry include fluorescent dyes, and the like. It is preferable to formulate a fluorescent dye, and the like, to an aqueous slurry, from the viewpoint of suppressing unevenness in coloring, and the like.

The contents of the water-insoluble inorganic compound, the water-soluble polymer and the water-soluble salt in the aqueous slurry are respectively more preferably within the ranges of from 30 to 75% by weight, from 3 to 20% by weight, and from 10 to 67% by weight, especially preferably within the ranges of from 40 to 70% by weight, from 5 to 20% by weight, and from 20 to 55% by weight, on the basis of solid ingredients in the aqueous slurry.

2. (b) Component

The surfactant composition, (b) component, includes, for instance, a composition comprising a surfactant exhibiting a liquid state during the mixing operation of step (I). Therefore, in addition to liquid surfactants at the temperature of mixing operation, even a solid surfactant at that temperature can be used in this process as the surfactant, as long as the surfactant can be obtained as a solution or suspension for dissolving or dispersing in an appropriate medium.

As the surfactant, an anionic surfactant, a nonionic surfactant, an amphoteric surfactant and a cationic surfactant may be used alone, or in combination of two or more kinds. It is more preferable that (b) component comprises a nonionic surfactant and an immobilization agent of the nonionic surfactant. In addition, in the present specification, one of the embodiments of the surfactant composition includes a surfactant composition comprising a nonionic surfactant; from 0 to 300 parts by weight of an anionic surfactant having sulfate group or sulfo group, based on 100 parts by weight of the nonionic surfactant; and from 1 to 100 parts by weight of an immobilization agent of the nonionic surfactant, based on 100 parts by weight of the nonionic surfactant. The anionic surfactant having sulfate group or sulfo group is more preferably from 20 to 200 parts by weight, based on 100 parts by weight of the nonionic surfactant. The surfactant composition having the above composition is more preferable, because the desirable foaming ability and detergency performance can be obtained.

The nonionic surfactant in (b) component is preferably those having a melting point of 30° C. or less, more preferably 25° C. or less, from the viewpoint of the detergency. Especially, a polyoxyalkylene alkyl ether obtained by adding 6 to 10 moles of an alkylene oxide to an alcohol having 10 to 14 carbon atoms is preferable. Here, preferable as an alkylene oxide is ethylene oxide. In addition, the nonionic surfactant may be used in the form of an aqueous solution.

The content of the nonionic surfactant is preferably from 25 to 99% by weight, more preferably from 30 to 95% by weight, of (b) component.

The immobilization agent of the nonionic surfactant in (b) component means a base material capable of suppressing the flowability of the nonionic surfactant which is liquid at an ordinary temperature and remarkably enhancing the hardness in a state in which the flowability of the surfactant composition comprising the above nonionic surfactant is lost. Specifically, it means a component is capable of suppressing the flowability of the above nonionic surfactant, for instance, at 25° C., enhancing the hardness of (b) component in a temperature range of less than a pour point of (b) component, and suppressing the viscosity of (b) component to 10 Pa•s or less, in a temperature range higher than a pour point of (b) component by 10° C. or more. The content of the immobilization agent in (b) component is preferably from 1 to 100 parts by weight, more preferably from 5 to 50 parts by weight, based on 100 parts by weight of the nonionic surfactant. Based on 100 parts by weight of the nonionic surfactant, the immobilization agent is preferably 1 part by weight or more, from the viewpoint of the immobilization ability of the nonionic surfactant, and the immobilization agent is preferably 100 parts by weight or less, from the viewpoint of the dissolubility of the detergent particles.

The above immobilization agent includes, for instance, anionic surfactants such as salts of fatty acids, salts of hydroxyfatty acids, and alkyl phosphates; polyoxyalkyl-type nonionic compounds such as polyethylene glycols; polyether-type nonionic compounds, and the like. The immobilization agent is more preferably from 5 to 50 parts by weight, based on 100 parts by weight of the nonionic surfactant. The exudation of the surfactant during storage at ordinary temperature can be suppressed, because the surfactant composition comprising an immobilization agent is used.

Specifically, since the immobilization agent is formulated, there are exhibited highly remarkable effects that the viscosity of (b) component is not increased in a temperature range higher than the pour point of (b) component, and that the hardness of (b) component can be markedly enhanced in the temperature range of less than the pour point of (b) component, whereby the penetrability of (b) component through (a) component in the former temperature range can be maintained, and the exudation of the nonionic surfactant in the latter temperature range can be effectively suppressed (hereinafter referred to as "immobilization ability").

When the immobilization agent comprises an anionic surfactant, it is preferable that (b) component contains 5 to 25% by weight of water.

It is preferable that (b) component substantially comprises no fatty acids. This feature enables to achieve an increase in the amount of (b) component supported to (a) component and an improvement in the dissolubility of the detergent particles. Here, the term "substantially comprises no fatty acids" refers to a case where a content of a fatty acid is 1% or less, and it is preferable that the fatty acid is undetectable, when (b) component is subjected to quantification of fatty acids by a method in accordance with Standard Fats and Oils Analysis Test Method 2.4.1–71, Edited by Nippon Yukagaku Kyokai. The above effects are thought to be exhibited as follows. Concretely, when (b) component comprises a fatty acid, a salt of a fatty acid is formed by neutralization of the fatty acid with a component showing an alkaline property during mixing in step (I), whereby the salt of a fatty acid and the nonionic surfactant of (b) component are gelated. The formed gelated product inhibits the support of (b) component to (a) component, thereby lowering the supporting efficiency. In addition, a large aggregate is formed by the action of the gelated product as a binder, and (a) component is likely to undergo breakdown by applying a strong shearing force during mixing, and consequently making it disadvantageous in the dissolubility.

The viscosity of (b) component is determined by measuring using a B-type viscometer (commercially available by TOKYO KEIKI, Model "DVM-B") under the conditions of rotor No. 3, at 12 rpm. The pour point of (b) component is determined by a method in accordance with JIS K 2269.

It is preferable that (b) component further comprises an anionic surfactant having sulfate group or sulfo group. The content of the anionic surfactant is preferably from 20 to 200 parts by weight, more preferably from 30 to 180 parts by weight, based on 100 parts by weight of the nonionic surfactant. Based on 100 parts by weight of the nonionic surfactant, the anionic surfactant is preferably 20 parts by weight or more, from the viewpoints of the suppression of the exudation of the nonionic surfactant and the improvement in the anti-caking ability, and the anionic surfactant is preferably 200 parts by weight or less, from the viewpoint of the dissolubility of the detergent particles. Since the anionic surfactant is formulated in (b) component, the exudation of the nonionic surfactant is further suppressed, and moreover, and the anti-caking ability of the detergent particles is improved, whereby detergent particles having desirable foaming ability and detergency performance can be obtained.

Concrete examples of the anionic surfactant having sulfate group or sulfo group include linear alkylbenzenesulfonates, alkyl sulfates, α-sulfonated fatty acid salts, polyoxyethylene alkyl ether sulfates, and the like.

The amount of the surfactant composition formulated is 15 parts by weight or more, preferably 20 parts by weight or more, more preferably 25 parts by weight or more, especially preferably 30 parts by weight or more, based on 100 parts by weight of the base particle, from the viewpoint of exhibiting the detergency. The amount is 100 parts by weight or less, preferably 80 parts by weight or less, more preferably 70 parts by weight or less, based on 100 parts by weight of the base particle, from the viewpoints of the dissolubility and the flowability. Therefore, from the viewpoints of the detergency, the dissolubility and the flowability, the amount is preferably from 15 to 100 parts by weight, more preferably from 20 to 100 parts by weight, still more preferably from 25 to 80 parts by weight, especially preferably from 30 to 70 parts by weight, based on 100 parts by weight of the base particle.

3. Powder Raw Materials Other than (a) Component

In the present invention, powder raw materials other than (a) component may be used. The term "powder raw materials other than (a) component" as referred to in the present specification means a detergency-enhancing agent or an oil-absorbing agent which is powdery at an ordinary temperature, for instance, 25° C. Concretely, the powder raw materials are base material agents exhibiting a metal ion capturing ability such as zeolite and citrates; base material agents exhibiting an alkalizing ability such as sodium carbonate and potassium carbonate; base material agents exhibiting both a metal ion capturing ability and an alkalizing ability such as crystalline silicates; amorphous silica and amorphous aluminosilicates exhibiting poor metal ion capturing ability but high oil-absorbing ability; powder surfactants, and the like. By using the above powder raw materials in combination with (a) component as desired, an increase in the amount of (b) component formulated and the reduction of the deposition of the mixture within the mixer can be achieved, and the improvement in detergency can also be achieved.

The powder raw materials other than (a) component are mixed by formulating as desired in step (I). The formulation amount in this case is preferably from 1 to 30 parts by weight, more preferably from 3 to 20 parts by weight, especially preferably from 3 to 15 parts by weight, based on 100 parts by weight of (a) component. The formulation amount, based on 100 parts by weight of (a) component, is preferably 1 part by weight or more, from the viewpoint of exhibiting the desired effects, and the formulation amount is preferably 30 parts by weight or less, from the viewpoint of the dissolubility.

4. Fine Powder

In the present specification, the term "fine powder" is a powder for coating the surface of a detergent particle which is formulated for the purpose of improving the flowability of the detergent particles, and those having high ion exchanging ability and high alkalizing ability are preferable from the viewpoint of the detergency. Concretely, aluminosilicates are preferable. Aside from the aluminosilicates, inorganic fine powders of calcium silicates, silicon dioxide, bentonite, talc, clay, amorphous silica derivatives and silicate compounds such as crystalline silicate compounds are preferable. In addition, metal soaps of which primary particle has a size of 10 μm or less can be similarly used.

The fine powder of which primary particle has an average particle size of from 0.1 to 10 μm is preferable, from the viewpoints of an improvement in the coating ratio of the surface of the detergent particle and an improvement in the flowability of the detergent particles. The average particle size of the fine powder can be measured by a method utilizing light scattering, for instance, by a particle analyzer (commercially available by Horiba, LTD.), or it may be measured by a microscopic observation.

The amount of the fine powder used, based on 100 parts by weight of the mixture obtainable in step (I), is 5 parts by weight or more, more preferably 10 parts by weight or more, from the viewpoint of obtaining particles. In addition, the amount is 100 parts by weight or less, preferably 75 parts by weight or less, especially preferably 50 parts by weight or less, from the viewpoint of the flowability.

5. Process for Preparing Detergent Particles 5-1. Step (I)

As to the mixing conditions in step (I), there may be selected mixing conditions such that the base particle does not substantially undergo breakdown. For instance, when a mixer comprising agitation impellers is used, in a case where a mixer comprises agitation impellers of which mixing impellers have a shape of a paddle-type, the agitation impellers have a Froude number of preferably from 0.5 to 8, more preferably from 0.8 to 4, especially preferably from 0.8 to 2, from the viewpoints of suppression of the breakdown of the base particle and the mixing efficiency. In addition, in a case where the mixing impellers have a shape of a screw-type, the agitation impellers have a Froude number of preferably from 0.1 to 4, more preferably from 0.15 to 2. Also, in a case where the mixing impellers have a shape of a ribbon-type, the agitation impellers have a Froude number of preferably from 0.05 to 4, more preferably from 0.1 to 2.

Further, there may be also employed a mixer comprising agitation impellers and disintegration impellers. When powders and liquids are mixed by using the above mixer, the disintegration impellers have been conventionally subjected to high-speed rotation, from the viewpoint of accelerating mixing. However, in the present invention, in the above embodiment, it is preferable not to substantially rotate the disintegration impellers, from the viewpoint of the suppression of breakdown of the base particle. The phrase "substantially not rotate the disintegration impellers" refers to completely no rotations of the disintegration impellers at all, or some rotations of the disintegration impellers, for the purpose of preventing residence of various raw materials near the disintegration impellers, within a range such that the base particle does not substantially undergo breakdown, in consideration of shapes, sizes, and the like of the disintegration impellers. Concretely, in a case where the disintegration impellers are continuously rotated, the Froude number is 200 or less, preferably 100 or less, and in a case where the disintegration impellers are intermittently rotated, the Froude number is not particularly limited. The mixture can be obtained without substantially undergoing breakdown of the base particle by mixing under the conditions described above.

In this step, a state where (a) component does not substantially undergo breakdown refers to a state such that 70% or more of (a) component in the mixture maintains its shape. Its method for confirmation includes, for instance, a method of subjecting to SEM observation granules obtained after extracting a soluble fraction from a mixture obtained by using an organic solvent. When (a) component does not substantially undergo breakdown, there are advantages that the dissolubility and the flowability of the detergent particles are improved.

The Froude number as defined in the present specification is calculated by the following equation.

$$\text{Froude Number}=V^2/(R\times g),$$

wherein

V: a peripheral speed [m/s] of a tip end portion of an agitating impeller or disintegration impeller;

R: a rotational radius [m] of an agitating impeller or disintegration impeller; and g: gravitational acceleration [$m/s^2$].

Further, in a case where (a) component is susceptible to undergo breakdown, (b) component may be supported to (a) component by arbitrarily adjusting a number of rotations of the agitation impellers (including stopping). Preferable mixing time (in the case of batch process) and average residence time (in the case of continuous process) are, for instance, preferably from 1 to 20 minutes, especially preferably from 2 to 10 minutes.

In step (I), (a) component is mixed with (b) component, under conditions such that a maximum temperature of a mixture of (a) component and (b) component during an initiation of mixing and a termination of mixing is preferably a pour point of (b) component or higher, more preferably higher than the pour point by 5° C. or more, still more preferably higher than the pour point by 10° C. or more. By mixing under the conditions described above, the breakdown of (a) component can be suppressed, thereby supporting (b) component to (a) component. Mixing is carried out with maintaining a temperature of a mixture of (a) component and (b) component during an initiation of mixing and a termination of mixing at a pour point of (b) component or higher, more preferably higher than the pour point by 5° C. or more, still more preferably higher than the pour point by 10° C. or more, from the viewpoint of more effectively exhibiting the above effects. In addition, the temperature of the mixture is preferably adjusted to 95° C. or lower, more preferably 90° C. or lower, from the viewpoint of the thermal stability of (b) component.

Since (b) component has a state exhibiting flowability, not a hard paste or solid state, by adjusting the maximum temperature of the mixture to the pour point of (b) component or higher, (b) component can be easily penetrated through (a) component by simply mixing together (a) component and (b) component under the above temperature conditions. Further, since (b) component is always in a state exhibiting the flowability described above throughout step (I) by mixing the components, with maintaining the temperature of the mixture at a pour point of (b) component or higher, (b) component can be very highly efficiently penetrated through (a) component. In a case where (b) component is in a state of hard paste or solid, a strong shearing force is acted to (a) component owing to the strong adhesiveness exhibited by (b) component, thereby giving rise to a possible breakdown of (a) component. The shearing force acting on (a) components themselves can be reduced by maintaining a temperature of the mixture at a pour point of (b) component or higher, whereby the breakdown of (a) component can be suppressed. Accordingly, from these aspects, it is preferable that the mixing operation is carried out in a state where (b) component exhibits flowability.

The pour point of the surfactant composition is a value determined by a method in accordance with JIS K 2269. The temperature of the mixture is determined by an on-line measurement by setting a thermocouple at a position less likely to be influenced by a jacket or the like in the mixer.

A preferable embodiment for satisfying the above temperature conditions is to initiate mixing after raising each of the temperatures of (a) component and (b) component to a pour point of (b) component or higher. In addition, in order to maintain the temperature of the mixture at a pour point or higher as mentioned above, it is preferable to previously adjust the jacket temperature to a pour point of (b) component or higher by allowing warm water or the like to flow through the jacket prior to mixing operation. The jacket temperature is preferably higher than the pour point by 5° C. or more, especially preferably higher than the pour point by 10° or more. In addition, the jacket temperature is preferably 95° C. or lower, more preferably 90° C. or lower, from the viewpoint of the thermal stability of (b) component.

As the method for adjusting a temperature of (a) component, when (a) component is obtained by spray-drying, it is preferable that the temperature of the particle immediately after spray-drying is usually a relatively high temperature, and that the particle is supplied in the mixer such that this temperature can be maintained. In addition, the temperature of the particle before or after supplying to the mixer can be previously heated by, for instance, a hot air.

As the process for adding (b) component, a process comprising previously mixing each of ingredients constituting (b) component, i.e. a nonionic surfactant, an immobilization agent, and an anionic surfactant if used, and adding the mixture into the mixer is preferable.

A process for mixing a surfactant composition and base particles may be a batch process or a continuous process. In the case of mixing by a batch process, it is preferable to previously supply base particles in a mixer, and thereafter add thereto a surfactant composition in a liquid state. Especially, it is preferable to feed the surfactant composition in a liquid state by spraying. The temperature of the surfactant composition to be fed is preferably higher than a pour point of the surfactant composition by 10° C. or more, more preferably higher than the pour point by 20° C. or more.

In the case where mixing is carried out by a batch process, the mixer is not particularly limited, as long as a mixer which can satisfy the present invention is employed. Examples of the mixers of which mixing impellers have a shape of a paddle-type include (1) a mixer in which blending of powders is carried out by having an agitating shaft in the inner portion of a mixing vessel and attaching agitating impellers on the agitating shaft, including Henschel Mixer (manufactured by Mitsui Miike Machinery Co., Ltd.); High-Speed Mixer (Fukae Powtec Corp.); Vertical Granulator (manufactured by Powrex Corp.); Lödige Mixer (manufactured by Matsuzaka Giken Co., Ltd.); PLOUGH SHARE Mixer (manufactured by PACIFIC MACHINERY & ENGINEERING Co., LTD.); mixers disclosed in Japanese Patent Laid-Open Nos. Hei 10-296064 and Hei 10-296065, and the like. Examples of the mixers of which mixing impellers have a shape of a ribbon-type include (2) a mixer in which blending is carried out by rotating spiral ribbon impellers in a non-rotatable vessel which is cylindrical, semi-cylindrical, or conical, including Ribbon Mixer (manufactured by Nichiwa Kikai Kogyo K. K.); Batch Kneader (manufactured by Satake Kagaku Kikai Kogyo K. K.); Ribocone (manufactured by K. K. Ohjun Seisakusho), and the like. Examples of the mixers of which mixing impellers have a shape of a screw-type include (3) a mixer in which blending is carried out by revolving a screw along a conical vessel, with autorotation centering about a rotating shaft arranged parallel to the vessel wall, including Nauta Mixer (manufactured by Hosokawa Micron Corp.), SV Mixer (Shinko Pantec Co., Ltd.) and the like.

Among the above mixers, a preference is given to a mixer in which blending of powders is carried out by having an agitating shaft arranged along the center line of a horizontal, cylindrical blending vessel and attaching agitating impellers arranged on the agitating shaft, including Lödige Mixer (manufactured by Matsuzaka Giken Co., Ltd.), PLOUGH SHARE Mixer (manufactured by PACIFIC MACHINERY & ENGINEERING Co., LTD.), mixers disclosed in Japanese Patent Laid-Open Nos. Hei 10-296064 and Hei 10-296065, and the like. Since step (II) described below can be carried out by the same mixer, these mixers are preferable from the viewpoint of the simplification of the equipments. Especially, the mixers disclosed in Hei 10-296064 and Hei 10-296065 are preferable, because the moisture content and the temperature of the mixture can be controlled by ventilation, whereby the breakdown of the base particles can be suppressed. In addition, mixers such as conical screw mixers and Ribbon Mixers capable of mixing powders and liquids without applying a strong shearing force are preferable, from the viewpoint that the breakdown of the base particle can be suppressed.

In addition, in a case where mixing is carried out in a continuous process, the mixer is not particularly limited, as long as a continuous mixer which can satisfy the present invention is employed. For instance, base particles and a surfactant composition may be mixed by using a continuous mixer among the above mixers.

The form of the mixture of the powder and the liquid is described in literatures such as "Funtaikogaku Yogo Jiten" (published by Nikkan Kogyo Shinbunsha, 1981), which is summarized in Table 1. It is more preferable that the mixture obtainable in step (I) has any one of forms in Funicular Region II, Capillary Region, and Slurry Region. Such a form of the mixture means that the surfactant composition in the mixture is present in an amount capable of supporting the base particles or more. By having a mixture in such a form, the surfactant composition can be formulated at a high level, as compared to those in Pendular Region and Funicular Region I. Moreover, the mixture can have a whipping form, and as a result, a shearing force (kneading resistance) acting among the base particles can be reduced. Therefore, the breakdown of the base particle can be suppressed. In addition, the effects of surface coating by fine powder can be efficiently exhibited, as long as the mixture has any one of forms in Funicular Region II, Capillary Region, and Slurry Region, so that detergent particles having excellent flowability can be obtained. The confirmation of which form of the region the mixture belongs is carried out by using a magnifying glass or the like, whereby the mixture can be classified into the most appropriate category in Table 1.

TABLE 1

| | Form of Mixture | | | | |
|---|---|---|---|---|---|
| | Pendular Region | Funicular Region I | Funicular Region II | Capillary Region | Slurry Region |
| Solid | Continuous | Continuous | Continuous | Discontinuous | Discontinuous |
| Liquid | Discontinuous | Continuous | Continuous | Continuous | Continuous |
| Gas | Continuous | Continuous | Discontinuous | None | None |

In order that the mixture has any one of forms of Funicular Region II, Capillary Region and Slurry Region, the amount of the surfactant composition may be appropriately adjusted in consideration of the amount capable of being supported to the base particles.

In addition, when the powder raw materials other than the base particles are formulated in step (I), it is preferable that the powder raw materials are supplied to the mixer before adding the surfactant composition. It is preferable that the mixing conditions when the powder raw materials are formulated are the same conditions as those where the base particles and the surfactant composition are mixed.

5-2. Step (II)

In this step, the fine powder is mixed with the mixture obtainable in step (I), whereby the fine powder coats the surface of the mixture (base particles comprising a surfactant composition), to give detergent particles having excellent flowability. When the surfactant composition forms a continuous phase as in a case where the mixture has a form of Funicular Region II, Capillary Region and Slurry Region, the fine powder has the functions of the pulverization aid for making the continuous phase discrete in the early stage of mixing.

When the mixture obtainable in step (I) does not show a powdery form (for instance, where (b) component constitutes a continuous phase, as in a case of a pasty or whipping form), in step (II), there is included a step for disintegrating the mixture using the fine powder as an aid.

As the mixing conditions in step (II), there may be selected mixing conditions such that the form of the base particle comprising the surfactant composition is substantially maintained. Preferable mixing conditions are the use of a mixer comprising both agitation impellers and disintegration impellers. When the above mixer is used, the agitation impellers provided in the mixer have a Froude number of preferably 10 or less, more preferably 7 or less, from the viewpoint of the suppression of breakdown of the base particle. The Froude number is preferably 2 or more, more preferably 3 or more, from the viewpoints of the efficiencies in the mixing with the fine powder and in the dispersion of the fine powder. The disintegration impellers have a Froude number of preferably 200 or more, more preferably 500 or more, from the viewpoints of the efficiencies in the mixing with the fine powder and in the dispersion of the fine powder. The Froude number is preferably 8000 or less, more preferably 5000 or less, from the viewpoint of the suppression of the breakdown of the base particle. If the Froude number is in this range, the detergent particles having excellent flowability can be obtained. In step (II), however, in a case of mixing for the purpose of adjusting the temperature of the mixture, the Froude numbers for the agitation impellers and the disintegration impellers may be appropriately adjusted. In the present specification, the phrase "the base particle comprising the surfactant composition, the form of which is substantially maintained" means that 70% or more of each of the resulting detergent particle is constituted by one base particle, and that the base particle does not undergo breakdown. As the method of its confirmation, the same means as those of step (I) can be employed.

As the mixing conditions in this step, a temperature at which coating with the fine powder can be efficiently carried out with suppressing the breakdown of the base particle is preferable. Concretely, in the same manner as in step (I), the mixing is carried out under conditions that a maximum temperature of the mixed components of the mixture and the fine powder during an initiation of mixing and a termination of mixing is preferably a pour point of (b) component or higher, more preferably higher than the pour point by 5° C. or more, still more preferably higher than the pour point by 10° C. or more. From the viewpoint of further effectively exhibiting the above effects, the mixing is carried out with maintaining the temperature of the mixed components during an initiation of mixing and a termination of mixing at a pour point of (b) component or higher, more preferably higher than the pour point by 5° C. or more, still more preferably higher than the pour point by 10° C. or more. In addition, from the viewpoint of the thermal stability of (b) component, the temperature of the mixed components is preferably 95° C. or lower, more preferably 90° C. or lower. However, when the mixture obtained in step (I) has a form of Pendular Region or Funicular Region I, the temperature within the mixer may be a pour point of the surfactant composition added in step (I) or lower, and the temperature can be regulated to a desired temperature. The mixing time is preferably from 0.5 to 5 minutes or so, more preferably from 0.5 to 3 minutes or so. A method for regulating the temperature of the mixed components during mixing includes a process comprising feeding warm water through the jacket of the mixer as in the same manner in step (I).

In this step, the phrase "the state where (a) component does not substantially undergo breakdown" refers to a state in which 70% or more of (a) component in the detergent particle maintains its form. Its method for conformation includes a method of confirming the amount of the detergent particle constituted by one base particle by means of SEM observation.

Preferable mixers include, among the mixers exemplified in step (I), those comprising both agitation impellers and disintegration impellers. In addition, the temperature control of the mixture is facilitated by the use of separate mixers for step (I) and step (II). For instance, in a case where thermally unstable components such as perfume and enzymes are added part of the way or after termination of step (II), it is preferable to temperature-control the mixture in step (II). The temperature can be adjusted by setting a jacket temperature and ventilation. In a case where separate mixers are used for step (I) and step (II), in order to efficiently convey the mixture obtained in step (I) to a mixer for step (II), there is a preferred embodiment in which a part of the fine powder is added after the termination of step (I).

6. Detergent Particles

The detergent particle obtainable by the process of the present invention includes a detergent particle comprising a base particle as a core, wherein a uni-core detergent particle substantially comprises one base particle as a core in one detergent particle.

As an index for expressing uni-core property of the detergent particle, the degree of particle growth defined by the following equation can be used. The uni-core detergent particles in the present invention have a degree of particle growth of 1.5 or less, preferably 1.3 or less, more preferably 1.2 or less.

$$\text{Degree of Particle Growth} = \frac{\text{Average Particle Size of Final Detergent Particles}}{\text{Average Particle Size of Base Particles}}$$

The term "final detergent particles" refers to detergent particles obtained after step (II).

In the above uni-core detergent particle, since the intra-particle aggregation is suppressed, there is an advantage that a desired detergent is obtained in a high yield without forming particles (aggregated particle) having sizes outside the desired particle size range.

When the base particles are spray-dried particles, the detergent particles obtained by the process of the present invention can realize fast dissolubility. The term "fast dissolubility" refers to a property wherein the dissolution rate of the detergent particles as calculated by the following method is 90% or more.

A 1-L beaker (a cylindrical form having an inner diameter of 105 mm and a height of 150 mm, for instance, a 1-L glass beaker manufactured by Iwaki Glass Co., Ltd.) is charged with 1 L of hard-water cooled to 5° C. and having a water hardness corresponding to 71.2 mg $CaCO_3$/L (a molar ratio of Ca/Mg: 7/3). With keeping the water temperature constant at 5° C. with a water bath, water is stirred with a stirring bar (35 mm in length and 8 mm in diameter, for instance, Model "TEFLON MARUGATA-HOSOGATA"manufactured by ADVANTEC) at a rotational speed (800 rpm), such that a depth of swirling to the water depth is about ⅓. The detergent particles are weighed so as to be 1.00 g are supplied and dispersed in hard water mentioned above with stirring, and stirring is continued. After 60 seconds from supplying the detergent particles, a liquid dispersion of the detergent particle in the beaker is filtered with a standard sieve (100 mm in diameter) and a sieve-opening of 74 μm as defined by JIS Z 8801 (corresponding to ASTM No. 200) of a known weight. Thereafter, water-containing detergent particle remaining on the sieve is collected in an open vessel of a known weight together with the sieve. Incidentally, the operation time from the start of filtration to collection of the sieve is set at 10±2 sec. The insoluble remnants of the collected detergent particle are dried for one hour in an electric dryer heated to 105° C. Thereafter, the dried insoluble remnants are cooled by keeping in a desiccator with a silica gel at 25° C. for 30 minutes. After cooling the insoluble remnants, a total weight of the dried insoluble remnants of the detergent, the sieve and the collecting vessel is measured, and the dry weight of the detergent particles remaining on the sieve is determined. Thereafter, the dissolution rate (%) of the detergent particles is calculated by the following equation. Incidentally, the weight is determined by using an accurate balance.

$$\text{Dissolution Rate (\%)} = \{1-(T/S)\}\times 100$$

wherein

S is a weight (g) of the detergent particles supplied; and

T is a dry weight (g) of the detergent particles remaining on the sieve.

The bulk density of the detergent particles is 500 g/L or more, preferably from 500 to 1,000 g/L, more preferably from 600 to 1,000 g/L, especially preferably from 650 to 850 g/L. The method for determining a bulk density is the same as that for the base particles.

The average particle size of the detergent particles is preferably from 150 to 500 μm, more preferably from 180 to 350 μm. The method for determining an average particle size is the same as that for the base particles.

The flowability of the detergent particles is evaluated as flow time of preferably 10 seconds or shorter, more preferably 8 seconds or shorter. The flow time is a time period required for dropping 100 mL of powder from a hopper used in the determination of the bulk density as defined in JIS K 3362.

The anti-caking property of the detergent particles is evaluated as sieve permeability of preferably 90% or more, more preferably 95% or more. The testing method for caking property is as follows.

An open-top box having dimensions of 10.2 cm in length, 6.2 cm in width, and 4 cm in height is made out of a filter paper (No. 2, manufactured by ADVANTEC) by stapling the filter paper at four corners. An acrylic resin plate (15 g) and a lead plate (250 g) are placed on the box charged with a 50 g sample. The caking state after allowing the box to stand at a temperature of 35° C. and a humidity of 40% for 2 weeks is evaluated by calculating the permeability as follows.

<Permeability> A sample obtained after the above test is gently placed on a sieve (sieve opening: 4760 μm, as defined by JIS Z 8801), and the weight of the powder passing through the sieve is measured. The permeability (%) based on the sample obtained after the above test is calculated.

As to the exudation property of the detergent particles, the evaluation by the following test methods is preferably 2 rank or better, more preferably 1 rank. When the exudation property is ranked as above, it is preferable because contrivances are not necessary for prevention of deposition of the nonionic surfactant-containing powder to equipments during transportation, or for prevention for exudation to vessels.

The testing method for exudation property: Exudation State of a surfactant is visually examined at bottom (side not contacting with powder) of the vessel made of the filter paper after the anti-caking test. The examination is made based on the area of wetted portion occupying the bottom in the following 1 to 5 ranks.

Rank 1: not wetted; Rank 2: about one-quarter of the bottom area being wetted; Rank 3: about one-half the bottom area being wetted; Rank 4: about three-quarter of the bottom area being wetted; Rank 5: the entire bottom area being wetted.

The yield of the detergent particles is calculated from a weight percentage of a sample passing through a sieve having a sieve-opening of 1000 μm when the average particle size is determined. The yield is preferably 90% or more, more preferably 95% or more.

EXAMPLE 1

Detergent particles were obtained according to the following process.

One-hundred parts by weight (20 kg) of base particles as listed in Table 2 were supplied into Lödige Mixer (commercially available from Matsuzaka Giken Co., Ltd.; capacity: 130 L; equipped with a jacket), and the rotation of a main shaft (equipped with agitation impellers; rotational speed of the main shaft: 60 rpm; Froude number of agitation impellers: 1) was started. Incidentally, hot water at 80° C. was allowed to flow into the jacket at 10 L/minute, without rotating a chopper (equipped with disintegration impellers). Fifty parts by weight (10 kg) of a liquid surfactant composition at 80° C. was supplied into the above mixer over a period of 2 minutes, and thereafter the components were mixed for 5 minutes. Subsequently, 15 parts by weight (3 kg) of fine powder was supplied into this Lödige Mixer. The main shaft (rotational speed of the main shaft: 120 rpm; Froude number of agitation impellers: 4) and the chopper (rotational speed of the chopper: 3600 rpm; Froude number of disintegration impellers: 1300) were rotated for 1 minute, and thereafter 28 kg of detergent particles were obtained. The composition and the properties of the obtained detergent particles are shown in Table 2.

TABLE 2

| | Examples | | | | | | | | | | Comparative Examples | | |
|---|---|---|---|---|---|---|---|---|---|---|---|---|---|
| | 1 | 2 | 3 | 4 | 5 | 6 | 7 | 8 | 9 | 10 | 1 | 2 | 3 |
| Composition (Parts by Weight) | | | | | | | | | | | | | |
| Surfactant Composition | | | | | | | | | | | | | |
| Surfactant Composition 1 | — | — | — | — | — | 50 | — | — | — | — | — | — | 30 |
| Surfactant Composition 2 | 50 | 50 | 30 | 70 | 55 | — | 30 | 50 | 30 | 30 | 50 | 50 | — |
| Base Particles | | | | | | | | | | | | | |
| Spray-Dried Particle | 100 | 100 | 100 | 100 | 100 | 100 | 50 | 100 | 100 | 100 | 100 | 100 | 100 |
| Sodium Carbonate *1) | — | — | — | — | — | — | 50 | — | — | — | — | — | — |
| Powdery Raw Material | | | | | | | | | | | | | |
| Sodium Carbonate *2) | — | — | — | — | 5 | — | — | — | — | — | — | — | — |
| Crystalline Silicate *3) | — | — | — | — | 5 | — | — | — | — | — | — | — | — |
| Fine Powder | | | | | | | | | | | | | |
| Crystalline Aluminosilicate *4) | — | 50 | — | — | 50 | 50 | — | — | — | — | — | — | — |
| Amorphous Aluminosilicate *5) | 15 | — | 10 | 30 | — | — | 15 | 15 | 8 | 8 | 15 | 15 | — |
| Properties, etc. | | | | | | | | | | | | | |
| Average Particle Size [μm] | 245 | 260 | 235 | 290 | 250 | 230 | 275 | 255 | 230 | 235 | 415 | 380 | ND |
| Degree of Particle Growth | 1.09 | 1.16 | 1.04 | 1.29 | 1.11 | 1.02 | 1.07 | 1.13 | 1.02 | 1.04 | 1.84 | 1.69 | ND |
| Yield [%] | 98.6 | 98.5 | 99.4 | 96.8 | 98.2 | 98.9 | 98.8 | 99.0 | 99.6 | 99.5 | 84.3 | 78.5 | ND |
| Bulk Density [g/L] | 710 | 770 | 640 | 690 | 780 | 780 | 880 | 760 | 630 | 640 | 780 | 720 | ND |
| Flowability [s] | 6.4 | 6.5 | 6.6 | 5.9 | 6.1 | 6.0 | 6.2 | 6.4 | 6.5 | 6.4 | 5.8 | 11.5 | ND |
| Dissolution Ratio [%] | 98 | 98 | 98 | 96 | 97 | 99 | 92 | 99 | 99 | 99 | 65 | 72 | — |

*1): "DENSE ASH" (commercially available from Central Glass Co., Ltd.), average particle size of 290 μm, bulk density of 980 g/L, and particle strength of 2300 kg/cm$^2$

*2): "LIGHT ASH" (commercially available from Central Glass Co., Ltd.), average particle size of 100 μm

*3): Product prepared by pulverizing Na-SKS-6 (δ-$Na_2Si_2O_5$)(commercially available from Clariant) to an average particle size of 8 μm

*4): Zeolite 4A-type, average particle size: 3.5 μm

*5): Product prepared by pulverizing the composition of Preparation Example 2 described in Japanese Patent Laid-Open No. Hei 9-132794 to an average particle size of 8 μm ND: Undeterminable

EXAMPLES 2 TO 7

Detergent particles were obtained in the same manner as in Example 1 with each of the compositions listed in Table 2. The properties of the obtained detergent particles are shown in Table 2. Incidentally, in Example 5, the powdery raw materials were supplied simultaneously with the base particles.

EXAMPLE 8

One-hundred parts by weight (20 kg) of base particles as listed in Table 2 were supplied into a horizontal mixer described in the Japanese Patent Laid-Open No. Hei 10-296064 (capacity: 130 L; equipped with a jacket, auxiliary disintegration impellers and a gas-discharging pipe), and the rotation of a main shaft (equipped with auxiliary agitation impellers; rotational speed of the main shaft: 60 rpm; Froude number of agitation impellers: 1) was started. Incidentally, hot water at 80° C. was allowed to flow into the jacket at 10 L/minute, and hot air at 80° C. was supplied from the gas-discharging pipe at 0.3 $m^3$/minute, without rotating a chopper (equipped with disintegration impellers). Fifty parts by weight (10 kg) of a liquid surfactant composition at 80° C. was supplied into the above mixer over a period of 3 minutes, and thereafter the components were mixed for 5 minutes. Subsequently, the feeding of the hot air was stopped, and thereafter 15 parts by weight (3 kg) of fine powder was supplied into this mixer. The main shaft (rotational speed of the main shaft: 120 rpm; Froude number of agitation impellers: 4) and the chopper (rotational speed of the chopper: 3600 rpm; Froude number of disintegration impellers: 1300) were rotated for 1 minute, and thereafter 28 kg of detergent particles were obtained. The composition and the properties of the obtained detergent particles are shown in Table 2.

EXAMPLE 9

One-hundred parts by weight (14 kg) of base particles as listed in Table 2 were supplied into Nauta Mixer (commercially available from Hosokawa Micron Corporation; effective capacity: 30 L; equipped with a jacket), and the rotation of a screw (rotational speed of autorotation: 100 rpm; Froude number: 0.83; rotational speed of revolution: 4 rpm) was started. Incidentally, hot water at 80° C. was allowed to flow into the jacket at 10 L/minute. Thirty parts by weight (4.2 kg) of a liquid surfactant composition at 80° C. was supplied into the above mixer over a period of 3 minutes, and thereafter the components were mixed for 5 minutes, to give a mixture. Subsequently, an entire amount of the above mixture and 8 parts by weight (1.1 kg) of fine powder were supplied into Lödige Mixer (commercially available from Matsuzaka Giken Co., Ltd.; capacity: 130 L; equipped with a jacket), and a main shaft (rotational speed of the main shaft: 120 rpm; Froude number of agitation impellers: 4) and a chopper (rotational speed of the chopper: 3600 rpm; Froude number of disintegration impellers: 1300) were rotated for 1 minute. Subsequently, the components were mixed for 3 minutes, with rotating the main shaft (rotational speed of the main shaft: 60 rpm; Froude number of agitation impellers: 1) and without rotating the chopper, and thereafter 17 kg of detergent particles were obtained. Incidentally, warm water at 40° C. was allowed to flow into the jacket at 10 L/minute. The composition and the properties of the obtained detergent particles are shown in Table 2. The temperature of the detergent particles at this time was 48° C.

EXAMPLE 10

One-hundred parts by weight (25 kg) of base particles as listed in Table 2 were supplied into Ribbon Mixer (commercially available from Fuji Paudal Co., Ltd.; whole capacity: 90 L; equipped with a jacket), and the rotation (rotational speed: 67 rpm; Froude number: 0.85) was started. Incidentally, hot water at 80° C. was allowed to flow into the jacket at 10 L/minute. Thirty parts by weight (7.5 kg) of a liquid surfactant composition at 80° C. was supplied into the above mixer over a period of 3 minutes, and the components were then mixed for 5 minutes. Thereafter, a 5 parts by weight portion (1.25 kg) of fine powder was supplied into the Ribbon Mixer, and the components were mixed for 2 minutes, to give a mixture. Subsequently, an entire amount of the above mixture and 3 parts by weight (0.75 kg) of fine powder were supplied into Lödige Mixer (commercially available from Matsuzaka Giken Co., Ltd.; capacity: 130 L; equipped with a jacket). A main shaft (rotational speed of the main shaft: 120 rpm; Froude number of agitation impellers: 4) and a chopper (rotational speed of the chopper: 3600 rpm; Froude number of disintegration impellers: 1300) were rotated for 1 minute, and thereafter 33 kg of detergent particles were obtained. Incidentally, warm water at 40° C. was allowed to flow into the jacket at 10 L/minute. The composition and the properties of the obtained detergent particles are shown in Table 2.

Regarding to the form of the mixture prior to mixing with fine powder, as a result of determining from the observation with a magnifying glass, the forms of the mixtures of Examples 3, 9 and 10 were in Pendular Region, the forms of the mixtures of Examples 1, 2, and 5 to 8 were in Funicular II region, and the form of the mixture of Example 4 was in Capillary Region. The detergent particles of Examples 4 and 5 were more excellent in the detergency than the detergent particles of Example 3. In addition, the detergent particles of Examples 1 to 6 and 8 to 10 had fast dissolubility. In addition, the detergent particles of Examples 1 to 5, and 7 to 10 were more excellent in the exudation preventing property for surfactant composition than the detergent particles of Example 6.

It was found from the data on the degree of particle growth that each of the detergent particles obtained in Examples 1 to 10 was uni-core detergent particles.

In addition, soluble matter was extracted and removed from the obtained detergent particles using an organic solvent, and the resulting particles were observed. As a result, in each of Examples, the base particle did not substantially undergo breakdown, and the forms of the base particle comprising the surfactant composition were substantially maintained.

Incidentally, the surfactant compositions and the spray-dried particle used were the following:

Surfactant Composition 1: polyoxyethylene alkyl ether [commercially available from Kao Corporation under the trade name: "EMULGEN 108 KM" (average moles of ethylene oxides: 8.5; number of carbon atoms in alkyl moiety: 12 to 14; and melting point: 18° C.)]

Surfactant Composition 2: a composition of polyoxyethylene alkyl ether/polyethylene glycol/LAS-Na/water=42/8/42/8 (weight ratio) (pour point being 45° C.); polyoxyethylene alkyl ether ("EMULGEN 108 KM"); polyethylene glycol [commercially available from Kao Corporation under the trade name: "K-PEG 6000" (average molecular weight: 8500; melting point: 60° C.)]; and LAS-Na: dodecylbenzenesulfonate (commercially available from Kao Corporation under the trade name: NEOPELEX FS).

Spray-Dried Particle: a bulk density of 620 g/L, an average particle size of 225 μm, a particle strength of 320 kg/cm$^2$, and a composition: zeolite/sodium polyacrylate/sodium carbonate/sodium sulfate/water=50/10/20/15/5 (weight ratio).

The spray-dried particle used herein was prepared as follows.

Four-hundred and eighty kilograms of water was supplied to a 1-m$^3$ mixing vessel comprising agitation impellers. After the water temperature reached 55° C., 150 kg of an aqueous solution of 40% by weight sodium polyacrylate was added thereto. The mixture was stirred for 15 minutes, and thereafter 120 kg of sodium carbonate and 90 kg of sodium sulfate were added thereto. The resulting mixture was stirred for additional 15 minutes, and thereafter 300 kg of zeolite was added thereto. The resulting mixture was stirred for 30 minutes, to give a homogenous slurry. The final temperature of this slurry was 58° C.

This slurry was fed to a spray-drying tower by a pump, and sprayed from a pressure-spray nozzle attached near the top of the tower at a spraying-pressure of 25 kg/cm$^2$. The high-temperature gas to be supplied to the spray-drying tower was supplied from the bottom of the tower at a temperature of 225° C., and discharged from the top of the tower at 105° C.

COMPARATIVE EXAMPLE 1

Detergent particles were obtained according to the following process.

One-hundred parts by weight (20 kg) of a base particle was supplied into Lödige Mixer (commercially available from Matsuzaka Giken Co., Ltd.; capacity: 130 L; equipped with a jacket), and the rotation of a main shaft (equipped with agitation impellers; rotational speed of the main shaft: 120 rpm; Froude number of agitation impellers: 4) and a chopper (equipped with disintegration impellers; rotational speed of the chopper: 3600 rpm; Froude number of disintegration impellers: 1300) was started. Incidentally, hot water at 80° C. was allowed to flow into the jacket at 10 L/minute. Fifty parts by weight (10 kg) of a liquid surfactant composition at 80° C. was supplied into the mixer over a period of 2 minutes, and thereafter the components were mixed for 5 minutes. The form of this mixture was in Funicular I region.

Subsequently, 15 parts by weight (3 kg) of fine powder was supplied into this Lödige Mixer, and the main shaft (rotational speed of the main shaft: 120 rpm; Froude number of agitation impellers: 4) and the chopper (rotational speed of the chopper: 3600 rpm; Froude number of disintegration impellers: 1300) were rotated for 1 minute. Thereafter, 28 kg of detergent particles were obtained. The composition and the properties of the obtained detergent particles are shown in Table 2.

From the data on the degree of particle growth, the obtained detergent particles were not uni-core detergent particles. In addition, the yield was poor. In addition, these detergent particles were poor in the dissolubility, as compared to those of Example 1 having the same composition.

COMPARATIVE EXAMPLE 2

Detergent particles were obtained according to the following process.

One-hundred parts by weight (20 kg) of base particles were supplied into Lödige Mixer (commercially available from Matsuzaka Giken Co., Ltd.; capacity: 130 L; equipped with a jacket), and the rotation of a main shaft (equipped with agitation impellers; rotational speed of the main shaft: 60 rpm; Froude number of agitation impellers: 1) was started. Incidentally, hot water at 80° C. was allowed to flow into the jacket at 10 L/minute, without rotating a chopper (equipped with disintegration impellers). Fifty parts by weight (10 kg) of the above liquid surfactant composition at 80° C. was supplied into the mixer over a period of 2 minutes, and thereafter the components were mixed for 5 minutes. The form of this mixture was in Funicular II region.

Subsequently, 15 parts by weight (3 kg) of fine powder was supplied into this Lödige Mixer, and the main shaft (rotational speed of the main shaft: 60 rpm; Froude number of agitation impellers: 1) was rotated for 1 minute. Thereafter, 28 kg of detergent particles were obtained. The chopper was not also rotated in this process. The composition and the properties of the obtained detergent particles are shown in Table 2.

From the data on the degree of particle growth, the obtained detergent particles were not uni-core detergent particles. In addition, the yield was poor. In addition, the flowability and the dissolubility of the detergent particles were also poor.

COMPARATIVE EXAMPLE 3

Detergent particles were obtained in the same manner as in Example 1 with the composition listed in Table 2, provided that the mixing process for the fine powder was not carried out. The obtained detergent particles were not in a powdery state (Pendular region), so that the value of each of the properties could not be determined.

The obtained detergent particles had a low bulk density, and the properties were so poor in texture that the flowability was undeterminable.

The base particle used hereinbelow was prepared as described below.

Four-hundred and eighty kilograms of water was supplied to a 1-m$^3$ mixing vessel comprising agitation impellers. After the water temperature reached 55° C., 120 kg of sodium sulfate and 150 kg of sodium carbonate were added thereto. The mixture was stirred for 15 minutes, and thereafter 120 kg of a 40% by weight aqueous solution of sodium polyacrylate was added thereto. The resulting mixture was stirred for additional 15 minutes, and thereafter 252 kg of zeolite was added thereto. The resulting mixture was stirred for 30 minutes, to give a homogenous slurry. The final temperature of this slurry was 58° C. This slurry was subjected to spray-drying, and the resulting spray-dried particles were used as a base particle. The base particle had an average particle size of 245 μm, a bulk density of 610 g/L, a supporting ability of 50 mL/100 g, a particle strength of 350 kg/cm$^2$, and a composition (weight ratio) of zeolite/sodium polyacrylate/sodium carbonate/sodium sulfate/water of 42/8/25/20/5.

EXAMPLE 11

Detergent particles were obtained according to the following process.

One-hundred parts by weight (20 kg) of a base particle at 80° C. as listed in Table 3 was supplied into Lödige Mixer (commercially available from Matsuzaka Giken Co., Ltd.; capacity: 130 L; equipped with a jacket), and the rotation of a main shaft (rotational speed: 60 rpm) was started. Incidentally, hot water at 80° C. was allowed to flow into the jacket at 10 L/minute, without rotating a chopper. Forty-five parts by weight (9 kg) of a surfactant composition at 80° C. was supplied into the above mixer over a period of 2 minutes, and thereafter the components were mixed for 5 minutes. The temperature of the mixture immediately after introducing the surfactant was 73° C., and the temperature of the mixture after stirring for 5 minutes was 74° C.

Subsequently, 15 parts by weight (3 kg) of fine powder was supplied into this mixer, with continuing to feed hot water to the jacket. The main-shaft (rotational speed: 120 rpm) and the chopper (rotational speed: 3600 rpm) were rotated for 1 minute, and thereafter 30 kg of detergent particles were discharged. The properties of the obtained detergent particles are shown in Table 3.

TABLE 3

| | Examples | | Comp. Ex. |
|---|---|---|---|
| | 11 | 12 | 4 |
| Composition (Parts by Weight) | | | |
| Surfactant Composition | | | |
| Polyoxyethylene Alkyl Ether | 40 | 20 | 40 |
| Polyethylene Glycol | 5 | 2 | 5 |
| Sodium Dodecylbenzenesulfonate | — | 20 | — |
| Water | — | 3 | — |
| Base Particle (Spray-Dried Particle) | 100 | 100 | 100 |
| Fine Powder (Zeolite 4A, average particle size of 3.5 μm) | 15 | 15 | 15 |
| Properties | | | |
| Pour Point (° C.) of Surfactant Composition | 52.5 | 47.5 | 52.5 |
| Maximum Temperature (° C.) of Step (I) Mixture | 74 | 72 | 45 |
| Minimum Temperature (° C.) of Step (I) Mixture | 73 | 68 | 40 |
| Maximum Temperature (° C.) of Step (II) Mixture | 72 | 70 | 44 |
| Minimum Temperature (° C.) of Step (II) Mixture | 68 | 65 | 41 |
| Average Particle Size (μm) | 252 | 277 | 409 |
| Degree of Particle Growth | 1.03 | 1.13 | 1.67 |
| Bulk Density (g/L) | 780 | 790 | 820 |
| Exudation Property (2-Week Storage) | 2–3 | 2 | 2 |
| Anti-Caking Property (2-Week Storage) | 2–3 | 2 | 2 |
| Dissolution Ratio (%) | 97 | 95 | 85 |
| Yield (%) | 99 | 97 | 88 |

Here, as the polyoxyethylene alkyl ether, there was used one commercially available from Kao Corporation under the trade name of "EMULGEN 108 KM" (average moles of ethylene oxides: 8.5; number of carbon atoms in alkyl moiety: 12 to 14; melting point: 18° C.). As the polyethylene glycol, there was used one commercially available from Kao Corporation under the trade name of "K-PEG 6000" (average molecular weight: 8500; melting point: 60° C.). As sodium dodecylbenzenesulfonate, there was used one commercially available from Kao Corporation under the trade name of "NEOPELEX FS."

EXAMPLE 12

Detergent particles were obtained in the same manner as in Example 11 with the composition listed in Table 3. The temperature of the mixture immediately after supplying the surfactant was 72° C., and the temperature of the mixture after stirring for 5 minutes was 68° C. The properties of the obtained detergent particles are shown in Table 3. The detergent particles of Example 12 were more excellent in the anti-caking property and the exudation property than the detergent particles of Example 11.

From the finding that both of the final detergent particles obtained in Examples 11 and 12 were low in the degree of particle growth, they were uni-core detergent particles. In addition, as a result of observing the particles after extracting and removing soluble matter from the mixture obtained after the completion of step (I) and the final detergent particles using an organic solvent, the base particles in the mixture and the base particle in the detergent particles did not substantially undergo breakdown in each of Examples 11 and 12.

COMPARATIVE EXAMPLE 4

Detergent particles were obtained in the same manner as in Example 11, except for the temperature of the base particle and the temperature of hot water in the jacket. Specifically, the temperature of the base particles when supplied was 25° C., and the temperature of water flowing into the jacket was 25° C. The temperature of the mixture immediately after supplying the surfactant was 45° C., and the temperature of the mixture after stirring for 5 minutes was 40° C.

Subsequently, 15 parts by weight (3 kg) of fine powder was supplied into this Lödige Mixer. The main shaft (rotational speed: 120 rpm) and the chopper (rotational speed: 3600 rpm) were rotated for 1 minute, and thereafter 27 kg of detergent particles were discharged. The properties of the obtained detergent particles are shown in Table 3. Since the degree of granule growth was large, the obtained detergent particles were not uni-core detergent particles. In addition, their dissolubility was poor. As a result of observing the particles after extracting and removing soluble matter from the mixture obtained after the completion of step (I) and the final detergent particles using an organic solvent, the average particle sizes of the base particle were reduced to about 50% for the mixture, and reduced to about 40% for the final detergent particles.

INDUSTRIAL APPLICABILITY

According to the present invention, there can be provided a process for preparing detergent particles in which the preparation steps can be simplified, the variations in the properties of the detergent particles against the variations in the formulated amount of the surfactant composition can be suppressed, further the flowability of the detergent particles is excellent, and the surfactant composition can be formulated in large amounts. Further, according to the process of the present invention, there can be obtained detergent particles capable of having a large formulated amount of the surfactant, obtainable in a simplified preparation steps, excellent in the dissolubility, and excellent in the exudation suppression and the anti-caking property of the nonionic surfactant.

Equivalent

Those skilled in the art will recognize, or be able to ascertain using simple routine experimentation, many equivalents to the specific embodiments of the invention described in the present specification. Such equivalents are intended to be encompassed in the scope of the present invention as recited in the following claims.

The invention claimed is:

1. A process for preparing detergent particles, comprising the steps of:

(I): mixing a base particle for supporting a surfactant ((a) component); and 15 to 100 parts by weight of a surfactant composition ((b) component), based on 100 parts by weight of said (a) component, the base particle having an average particle size of from 150 to 500 μm, a bulk density of 400 g/L or more, and a particle strength of 50 kg/cm$^2$ or more, under mixing conditions such that 70% or more of said (a) component does not substantially undergo breakdown, to give a mixture;

wherein said base particle is obtained by spray-drying an aqueous slurry, wherein a mixing operation is carried out by using a mixer comprising agitation impellers of which mixing impellers have a shape of a paddle, wherein the agitation impellers have a Froude number of from 0.5 to 4, provided where the mixer further comprises disintegration impellers, the mixing operation is carried out under mixing conditions so as not to rotate the disintegration impellers, and (II): mixing the mixture obtained in step (I) with 5 to 100 parts by weight of fine powder, based on 100 parts by weight of the mixture, with substantially maintaining the shape of (a) component containing (b) component, to give detergent particles, wherein the detergent particles have a degree of particle growth of 1.3 or less, and a bulk density of 500 g/L or more.

2. A process for preparing detergent particles, comprising the steps of:

(I): mixing a base particle for supporting a surfactant ((a) component); and 15 to 100 parts by weight of a surfactant composition ((b) component), based on 100 parts by weight of said (a) component, the base particle having an average particle size of from 150 to 500 μm, a bulk density of 400 g/L or more, and a particle strength of 50 kg/cm$^2$ or more, under mixing conditions such that said (a) component does not substantially undergo breakdown, to give a mixture; wherein said base particle is obtained by spray-drying an aqueous slurry, wherein a mixing operation is carried out by using a mixer comprising agitation impellers of which mixing impellers have a shape of a screw, under mixing conditions wherein the agitation impellers have a Froude number of from 0.1 to 0.83, and (II): mixing the mixture obtained in step (I) with 5 to 100 parts by weight of fine powder, based on 100 parts by weight of the mixture, with substantially maintaining the shape of (a) component containing (b) component, to give detergent particles, wherein the detergent particles have a degree of particle growth of 1.3 or less, and a bulk density of 500 g/L or more.

3. A process for preparing detergent particles, comprising the steps of:

(I): mixing a base particle for supporting a surfactant ((a) component); and 15 to 100 parts by weight of a surfactant composition ((b) component), based on 100 parts by weight of said (a) component, the base particle having an average particle size of from 150 to 500 μm, a bulk density of 400 g/L or more, and a particle strength of 50 kg/cm$^2$ or more, under mixing conditions such that said (a) component does not substantially undergo breakdown, to give a mixture; wherein said base particle is obtained by spray-drying an aqueous slurry, wherein a mixing operation is carried out by using a mixer comprising agitation impellers of which mixing impellers have a shape of a ribbon, under mixing conditions wherein the agitation impellers have a Froude number of from 0.05 to 0.85, and (II): mixing the mixture obtained in step (I) with 5 to 100 parts by weight of fine powder, based on 100 parts by weight of the mixture, with substantially maintaining the shape of (a) component containing (b) component, to give detergent particles, wherein the detergent particles have a degree of particle growth of 1.3 or less, and a bulk density of 500 g/L or more.

4. The process according to any one of claims 1, 2 and 3, wherein in said step (II), a mixing operation is carried out by using a mixer comprising agitation impellers and disintegration impellers, under mixing conditions wherein the agitation impellers have a Froude number of 2 to 10, and wherein the disintegration impellers have a Froude number of 200 to 8,000.

5. The process according to claim 1, wherein the mixture obtainable in step (I) has any one of forms in Funicular II region, Capillary region, and Slurry region.

6. The process according to claim 1, wherein said (b) component is a surfactant composition comprising a nonionic surfactant and an immobilization agent for the surfactant, provided that the immobilization agent is 1 to 100 parts by weight, based on 100 parts by weight of the nonionic surfactant.

7. The process according to claim 1, wherein in step (I), mixing is carried out under conditions such that a maximum temperature of a mixture of said (a) component and said (b) component is a pour point of said (b) component or higher during a period between an initiation of mixing and a termination of mixing.

8. The process according to claim 1, wherein said (a) component has a surfactant-supporting ability of 20 mL/100 g or more.

9. The process according to claim 1, wherein said (b) component further comprises 20 to 200 parts by weight of an anionic surfactant having sulfate group or sulfo group, based on 100 parts by weight of the nonionic surfactant.

10. The process according to claim 1, wherein in step (I), mixing is initiated after raising the temperature of each of (a) component and (b) component to a temperature of a pour point of said (b) component or higher.

11. The process according to claim 1, wherein in step (I), mixing is carried out, with maintaining a temperature of a mixture of said (a) component and said (b) component at a pour point of said (b) component or higher during a period between an initiation of mixing and a termination of mixing.

12. The process according to claim 1, wherein the detergent particles have a dissolution rate of 90% or more, under conditions where the resulting detergent particles are supplied in water at 5° C.; stirred for 60 seconds under the stirring conditions that 1 g of the detergent particles are supplied to a one-liter beaker having an inner diameter of 105 mm which is charged with one-liter of hard water having 71.2 mg $CaCO_3$/L, wherein a molar ratio of Ca/Mg is 7/3, and stirred with a stirring bar of 35 mm in length and 8 mm in diameter at a rotational speed of 800 rpm; and filtered with a standard sieve having a sieve-opening of 74 μm as defined by JIS Z 8801, wherein the dissolution rate of the detergent particles is calculated by the equation:

$$\text{Dissolution Rate (\%)}=[1-(T/S)]\times 100$$

wherein S is a weight (g) of the detergent particles supplied; and T is a dry weight (g) of insoluble remnants of the detergent particles remaining on the sieve when an aqueous solution prepared under the above stirring conditions is filtered with the sieve, wherein drying conditions for the insoluble remnants are kept at a temperature of 105° C. for 1 hour, and then in a desiccator with a silica gel at 25° C. for 30 minutes.

13. The process for preparing detergent particles as recited in claim 1, wherein the agitation impellers have a Froude number of from 0.5 to 0.8.

* * * * *